US007204069B2

(12) United States Patent
Liao

(10) Patent No.: US 7,204,069 B2
(45) Date of Patent: Apr. 17, 2007

(54) CONTAINER SEALING DEVICE

(76) Inventor: Yu Chi Liao, No. 29, Lane 395, Sweiyuan Road, Fonyuan City, Taichung Hsien 42076 (TW)

( * ) Notice: Subject to any disclaimer, the term of this patent is extended or adjusted under 35 U.S.C. 154(b) by 94 days.

(21) Appl. No.: 11/124,881

(22) Filed: May 9, 2005

(65) Prior Publication Data

US 2006/0248860 A1 Nov. 9, 2006

(51) Int. Cl.
*B65B 31/04* (2006.01)
*B65B 51/14* (2006.01)

(52) U.S. Cl. ..... 53/510; 53/300; 53/329.5

(58) Field of Classification Search ..... 53/510, 53/329.3, 329.5, 300
See application file for complete search history.

(56) References Cited

U.S. PATENT DOCUMENTS 3,452,513 A * 7/1969 Owens, Jr. ..... 53/329.3
3,481,100 A * 12/1969 Bergstrom ..... 53/433
RE27,136 E * 6/1971 Schmidt ..... 53/432
3,724,161 A 4/1973 Vermeulen ..... 53/42
3,938,305 A 2/1976 Jansen et al. ..... 53/300
4,909,022 A * 3/1990 Kubis et al. ..... 53/510
4,982,555 A * 1/1991 Ingemann ..... 53/405
5,077,954 A * 1/1992 Williams ..... 53/89
5,272,854 A * 12/1993 Ye et al. ..... 53/329.2
5,419,101 A * 5/1995 Gorlich et al. ..... 53/510
5,534,282 A * 7/1996 Garwood ..... 426/396
5,718,101 A * 2/1998 Noel et al. ..... 53/432
5,930,977 A 8/1999 Hsu ..... 53/329.5
6,739,109 B1 * 5/2004 Fan ..... 53/329.3

FOREIGN PATENT DOCUMENTS

EP 581121 A1 * 2/1994

* cited by examiner

*Primary Examiner*—Stephen F. Gerrity
(74) *Attorney, Agent, or Firm*—Charles E. Baxley

(57) ABSTRACT

A container sealing device includes a platform slidable and movable in and out of a casing and having an opening for receiving a container to be sealed. A lever and a support device are slidably attached to the platform, and movable up and down relative to the platform, to support the container. The platform includes a peripheral bulge having a peripheral channel to form an inner peripheral wall which may support an outer flange of the container, and an outer peripheral wall having an orifice for supplying a food preserving agent to the container, and an aperture for vacuuming the container. The support device may be adjusted relative to the lever, to support containers of different heights or depths.

16 Claims, 7 Drawing Sheets

CONTAINER SEALING DEVICE

BACKGROUND OF THE INVENTION

1. Field of the Invention

The present invention relates to a container sealing device, and more particularly to a container sealing device having a structure for filling or introducing an object or a food preserving agent or gas or fluid into containers, to preserve and/or to prevent food, electric parts or other objects contained within the containers from being spoiled, decomposed, or the like.

2. Description of the Prior Art

Various kinds of typical container sealing devices have been developed and comprise a holder to hold and support a container, and a pressure plate movable to engage with the top of the container, and to apply or to attach or secure a biaxially oriented resin on top of the container.

For example, U.S. Pat. No. 3,724,161 to Vermeulen discloses one of the typical container sealing devices comprising a compression coil spring for urging a pressure plate downwardly to engage with a container, and to apply or to attach or secure a resin or film or membrane on top of the container. However, the container may not be vacuumed and gas also may not be filled into the container such that the food or beverage contained within the container may not be preserved.

U.S. Pat. No. 3,938,305 to Jansen et al. discloses another typical container sealing device comprising two bonding units disposed with mutual spacing on an endless conveyor, and a device for removing a covered container from one of the bonding units. The container may be provided with a bonded seam by application of heat and pressure in one of the bonding units, and then may be transferred to the other bonding unit. However, similarly, the container may not be vacuumed and gas also may not be filled into the container such that the food or beverage contained within the container may not be preserved.

U.S. Pat. No. 5,930,977 to Hsu discloses a typical automatic film-lid cohering machine including a film transmission structure, a film-lid cohering transmission structure, and a film-lid cohered object replacement device. Similarly, the container may not be vacuumed, and gas also may not be filled into the container such that the food or beverage contained within the container may not be preserved.

The typical container sealing devices or the typical automatic film-lid cohering machines may only be used to apply a film onto the containers, to seal the containers only, but may not be used to introduce or to insert the other objects into the containers.

The present invention has arisen to mitigate and/or obviate the afore-described disadvantages of the conventional sealing devices.

SUMMARY OF THE INVENTION

The primary objective of the present invention is to provide a container sealing device including a structure for filling or introducing an object or a food preserving agent or gas or fluid into containers, to preserve and/or to prevent food, electric parts or other objects contained within the containers from being spoiled, decomposed, or the like.

In accordance with one aspect of the invention, there is provided a container sealing device comprising a base, a casing provided above the base, at least one fence disposed on the base, and including a guide rail provided therein, and including a channel formed therein and having an inclined portion, a platform slidably engaged with the guide rail of the fence, and movable in and out of the casing, and including an opening formed therein for receiving a container to be sealed, a lever including at least one end slidably engaged in the channel of the fence, and coupled to the platform, to guide the lever to move up and down relative to the platform when the end of the lever slides along the inclined portion of the channel of the fence, a support device attached to the lever, for supporting the container to be sealed, a membrane supplied through the casing, and located above the container and the platform when the platform is moved into the casing, the platform including a peripheral bulge extended upwardly therefrom, and arranged around the opening thereof, and including a peripheral channel formed in the peripheral bulge, to define an outer peripheral wall and an inner peripheral wall, the platform including an orifice formed in the outer peripheral wall and communicating with the peripheral channel of the peripheral bulge, for coupling to a reservoir and for supplying a food preserving agent or gas or fluid into the peripheral channel and the opening of the platform, and thus for supplying the gas into the container, and a sealing device for sealing the membrane onto the outer peripheral flange of the container, to seal the container.

The lever includes a screw hole formed therein, the support device includes a threaded member for threading with the screw hole of the lever, and a board provided on top of the threaded member, for supporting the container to be sealed with the membrane. The lever includes a detector attached thereto, to detect whether the container has been disposed and supported on the board of the support device or not.

The platform includes an aperture formed in the outer peripheral wall and communicating with the peripheral channel of the peripheral bulge, for coupling to a vacuum device and for vacuuming the container. The inner peripheral wall of the peripheral bulge of the platform is lower than the outer peripheral wall, for supporting the outer peripheral flange of the container.

The fence includes a slot formed therein, and the guide rail includes two poles secured in the slot of the fence. The platform includes a bar secured to bottom thereof and having a depression formed therein for receiving and securing a pole, the pole of the bar is slidably engaged with the poles of the guide rail of the fence, to slidably attach the platform to the base.

A moving device may further be provided and coupled to the platform, to move the platform into and out of the casing. The sealing device includes a panel, and a heater member slidably attached to the panel, for being moved to heat and to seal the membrane onto the outer peripheral flange of the container.

The heater member includes at least one guide column extended therefrom and slidably with the panel, and a spring member engaged between the heater member and the panel, to bias the heater member to move away from the panel and then toward the inner peripheral wall and the outer peripheral flange of the container.

The panel includes a cutter blade extended therefrom, for cutting the membrane after the membrane has been heated and sealed onto the outer peripheral flange of the container. A presser rim is slidably attached to the panel, for being moved to depress and to force the membrane between the presser rim and the outer peripheral wall of the peripheral bulge of the platform.

The presser rim includes at least one guide pin slidably attached to the panel, and a spring member engaged onto the guide pin, and engaged between the presser rim and the panel, to bias the presser rim toward the outer peripheral wall.

A housing may further be provided and having the casing attached thereto, the housing includes a spindle extended forwardly therefrom, for rotatably supporting a reel of the membrane, and a rod extended forwardly therefrom, for receiving the membrane unwound from the spindle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
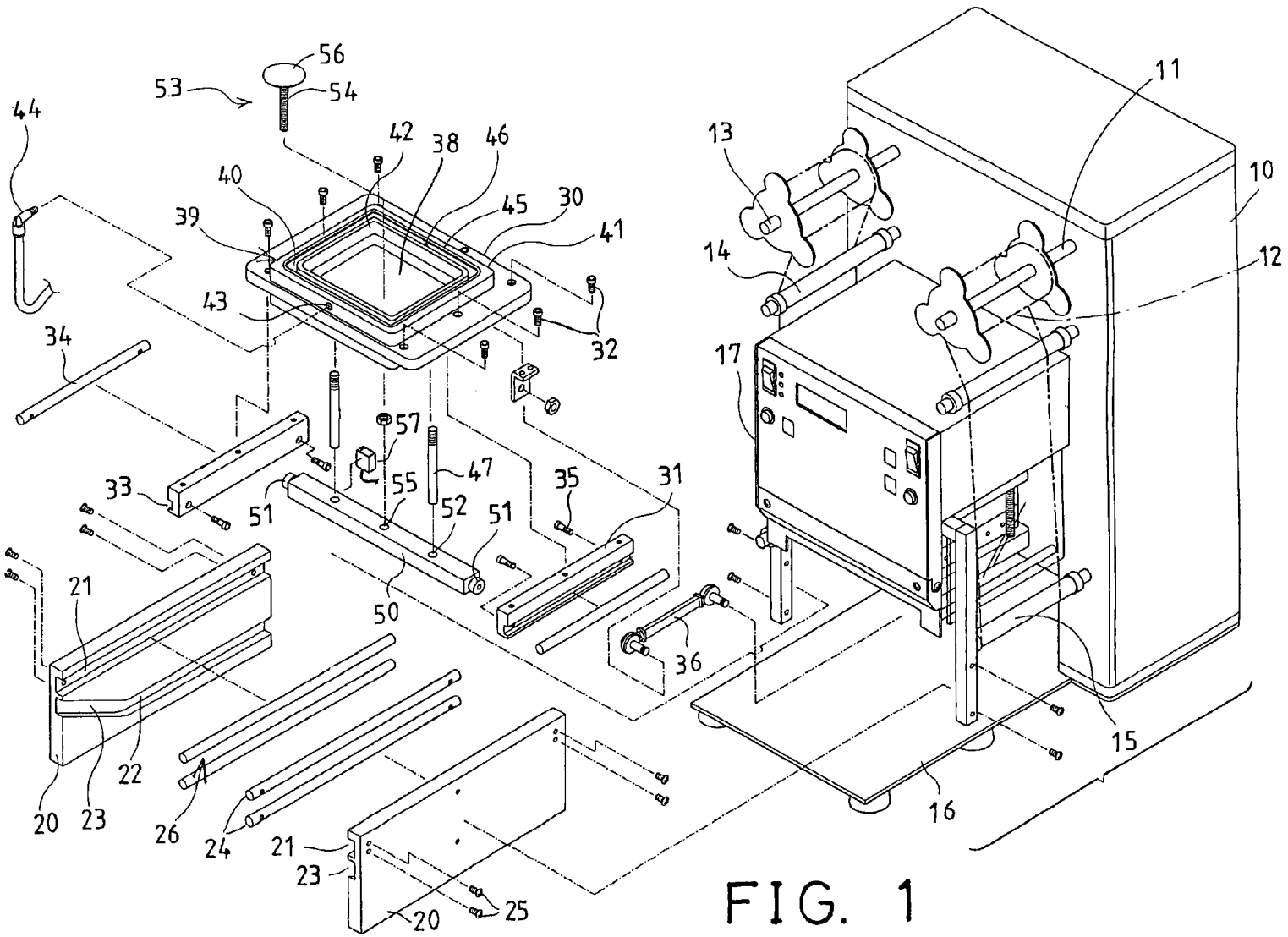
FIG. 1 is a partial exploded view of a container sealing device in accordance with the present invention.
Figure 2:
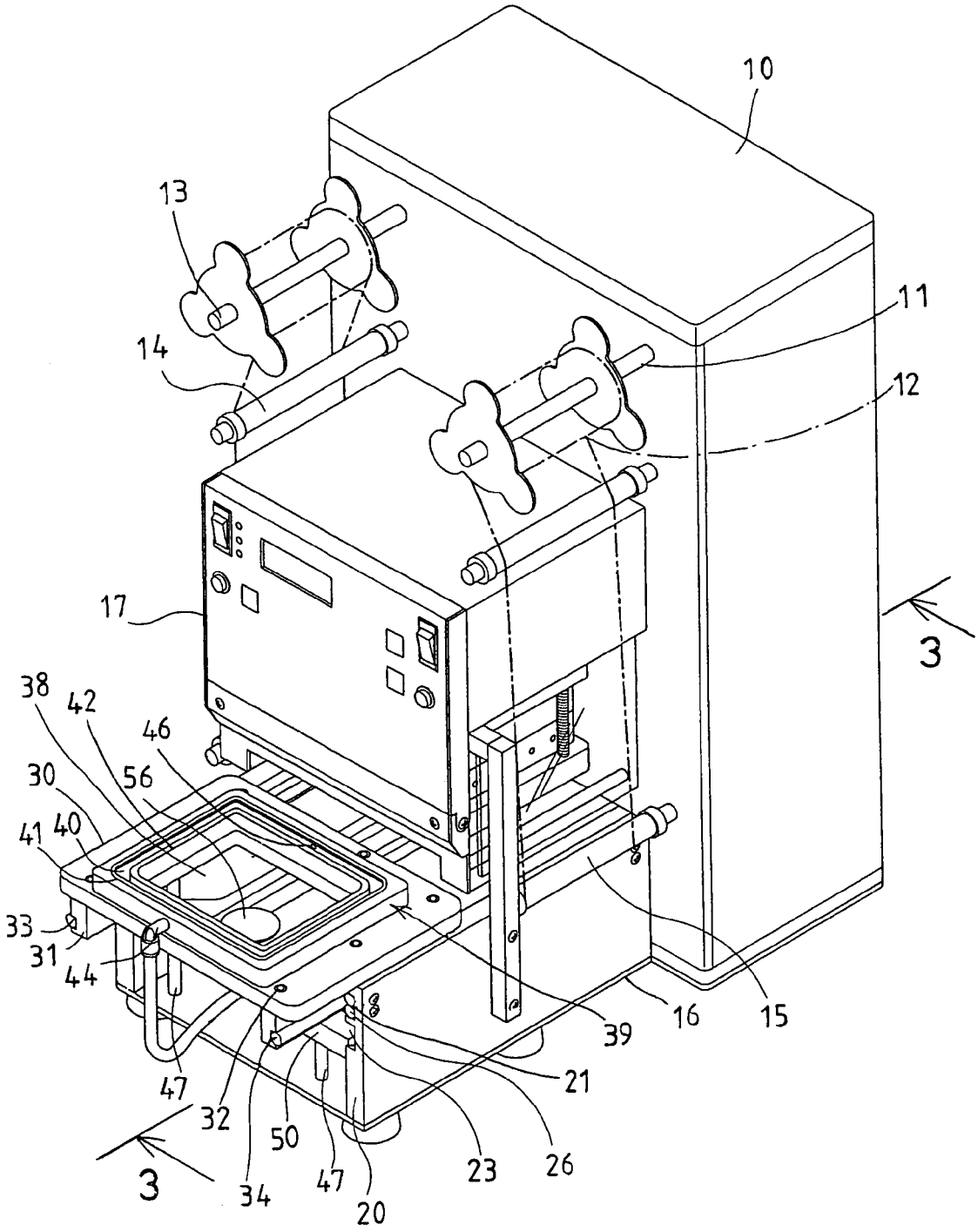
FIG. 2 is a perspective view of the container sealing device.
Figure 3:
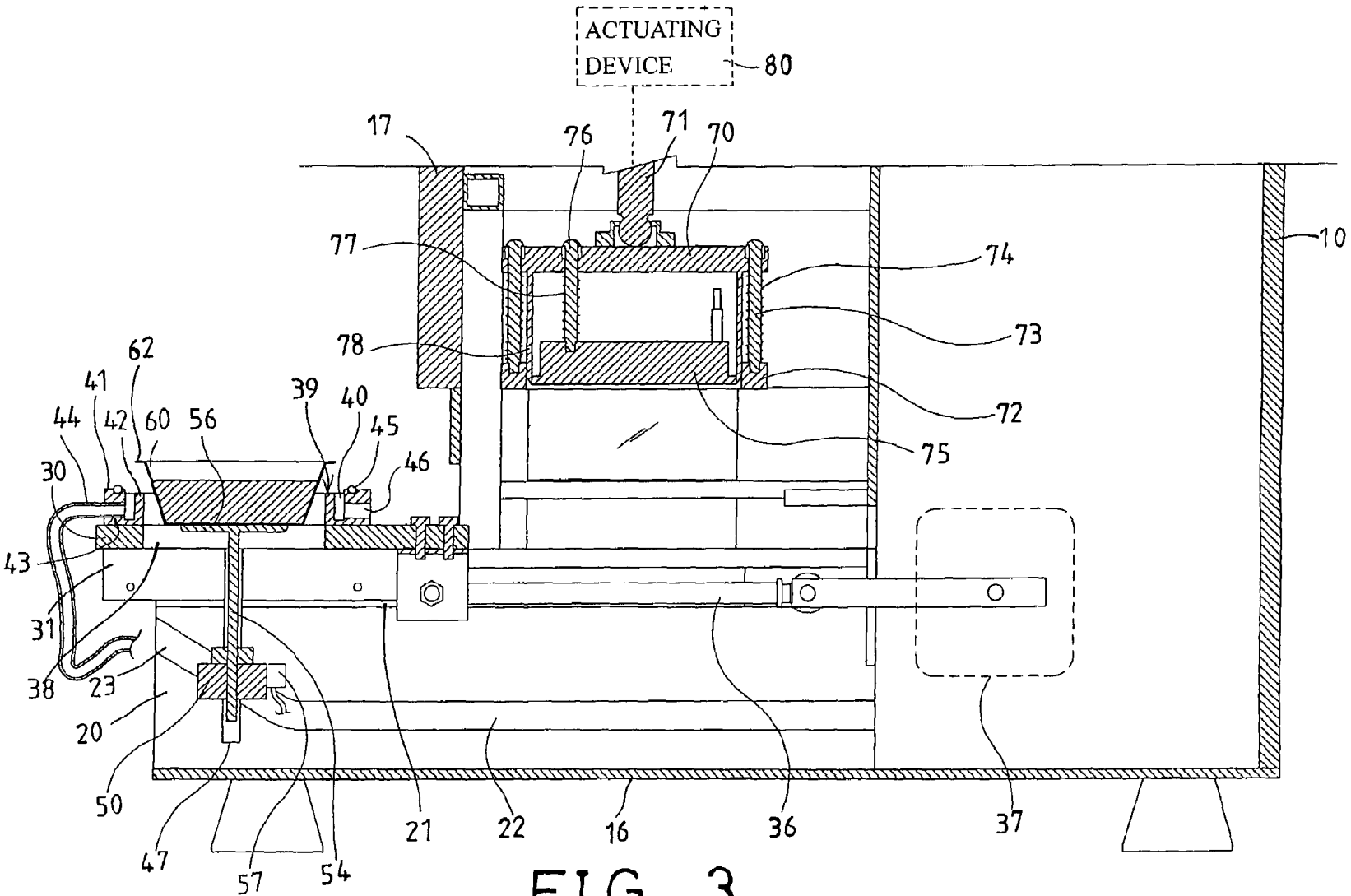
FIG. 3 is a partial cross sectional view of the container sealing device, taken along lines 3—3 of FIG. 2.
Figure 4:
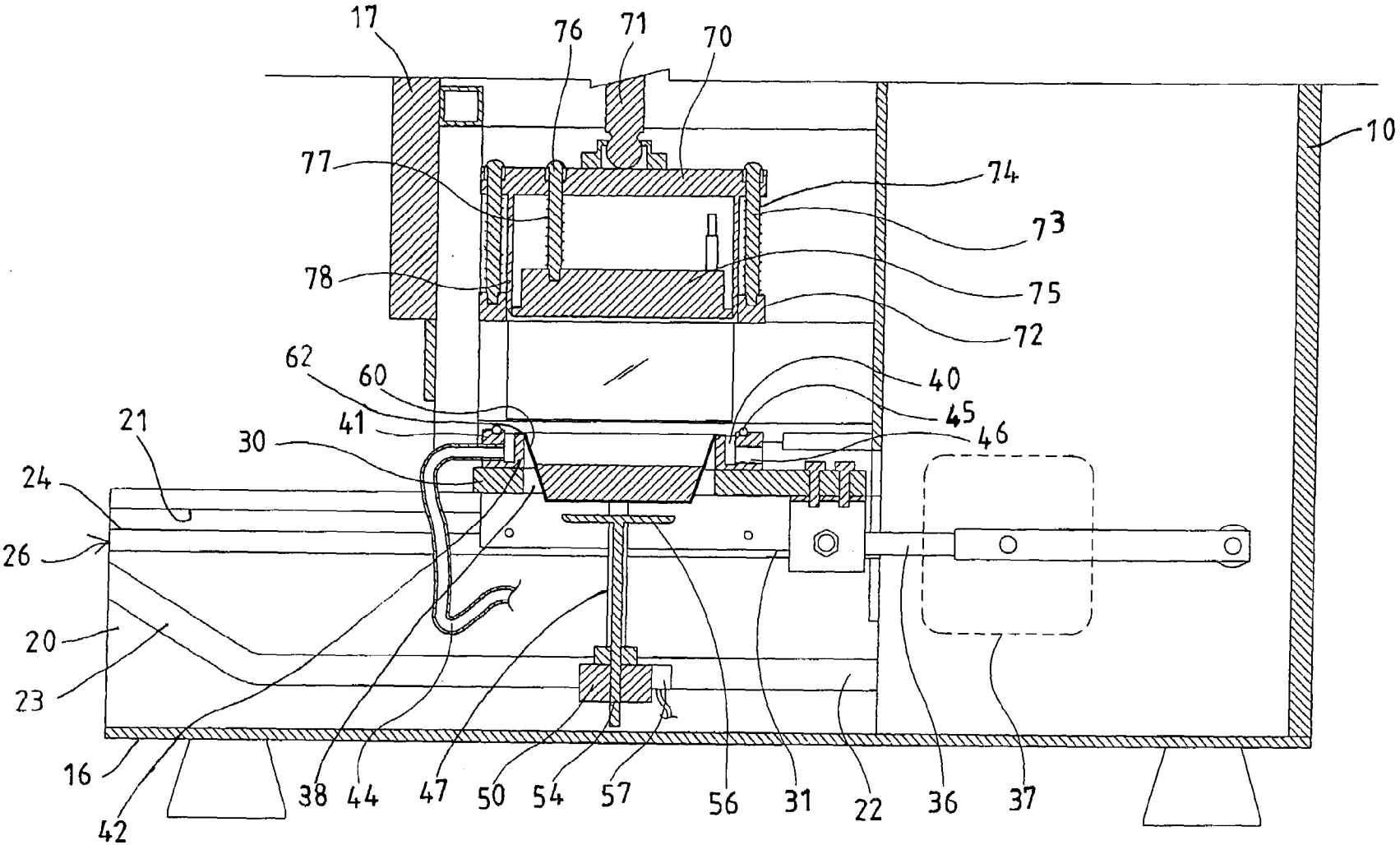
FIGS. 4, 5, 6, 7 are partial cross sectional views similar to FIG. 3, illustrating the operation of the container sealing device.

Referring to the drawings, and initially to FIGS. 1–3, a container sealing device in accordance with the present invention comprises a housing 10 including a spindle 11 extended forwardly therefrom, for rotatably supporting a reel of film or membrane or sealing member 12, and a rod 13 extended forwardly therefrom, for receiving the sealing member 12 unwound from the spindle 11. It is preferable that the housing 10 further includes one or more, such as four or two pairs of rollers 14, 15 extended forwardly therefrom, for engaging with the sealing member 12, and for facilitating the movement or the transferring of the sealing member 12 from the spindle 11 toward the rod 13.

The housing 10 further includes a base 16 extended forwardly from the bottom thereof, and further includes a casing 17 provided or extended forwardly from a middle portion thereof and preferably located above the base 16 and between the spindle 11 and the rod 13, and arranged for allowing the sealing member 12 unwound from the spindle 11 to move through a lower or bottom portion of the casing 17, best shown in FIGS. 1 and 2.

One or more, such as two fences 20 are disposed on the base 16, and spaced away from each other, and each includes a slot 21 and a channel 22 formed therein and facing toward and aligned with the slot 21 and the channel 22 of the other or the opposite fence 20. It is preferable that the channels 22 of the fences 20 each includes an upwardly curved or inclined front portion 23. Two poles 24 are secured in the slot 21 of each of the fences 20 with such as fasteners 25, to form a guide rail 26 (FIGS. 2, and 4–6).

A platform 30 is to be slidably supported on the base 16, or slidably attached to the casing 17 or the housing 10, and includes one or more, such as two bars 31 secured to bottom thereof with such as fasteners 32, and each having a depression 33 formed therein for receiving and securing another pole 34 therein with such as fasteners 35. The poles 34 may be slidably engaged with the poles 24 of the guide rails 26 of the fences 20 or of the base 10 or of the casing 17, to slidably attach the platform 30 to the base 16 and/or to the casing 17 and/or to the housing 10.

A link 36 is attached or secured to the platform 30, and is coupled to a moving means or device 37 (FIGS. 3–7), such as a hydraulic or pneumatic moving device 37, a solenoid moving device 37, a motorized screw or helical device 37, a motorized gearing device 37, or the like, which may be used to move the platform 30 into and out of the casing 17, best shown in FIGS. 3–7. The platform 30 includes an opening 38 formed therein, for receiving containers 60 to be sealed with a cap or cover 61 (FIG. 7) with the sealing member 12.

The platform 30 further includes a peripheral bulge 39 extended upwardly therefrom, and arranged around the opening 38 thereof, and includes a peripheral channel 40 formed within the peripheral bulge 39, to form or define an outer peripheral wall 41 and an inner peripheral wall 42, in which it is preferable that the inner peripheral wall 42 is slightly lower than the outer peripheral wall 41 (FIGS. 3–7), for supporting or seating an outer peripheral flange 62 of the container 60.

Figure 5:
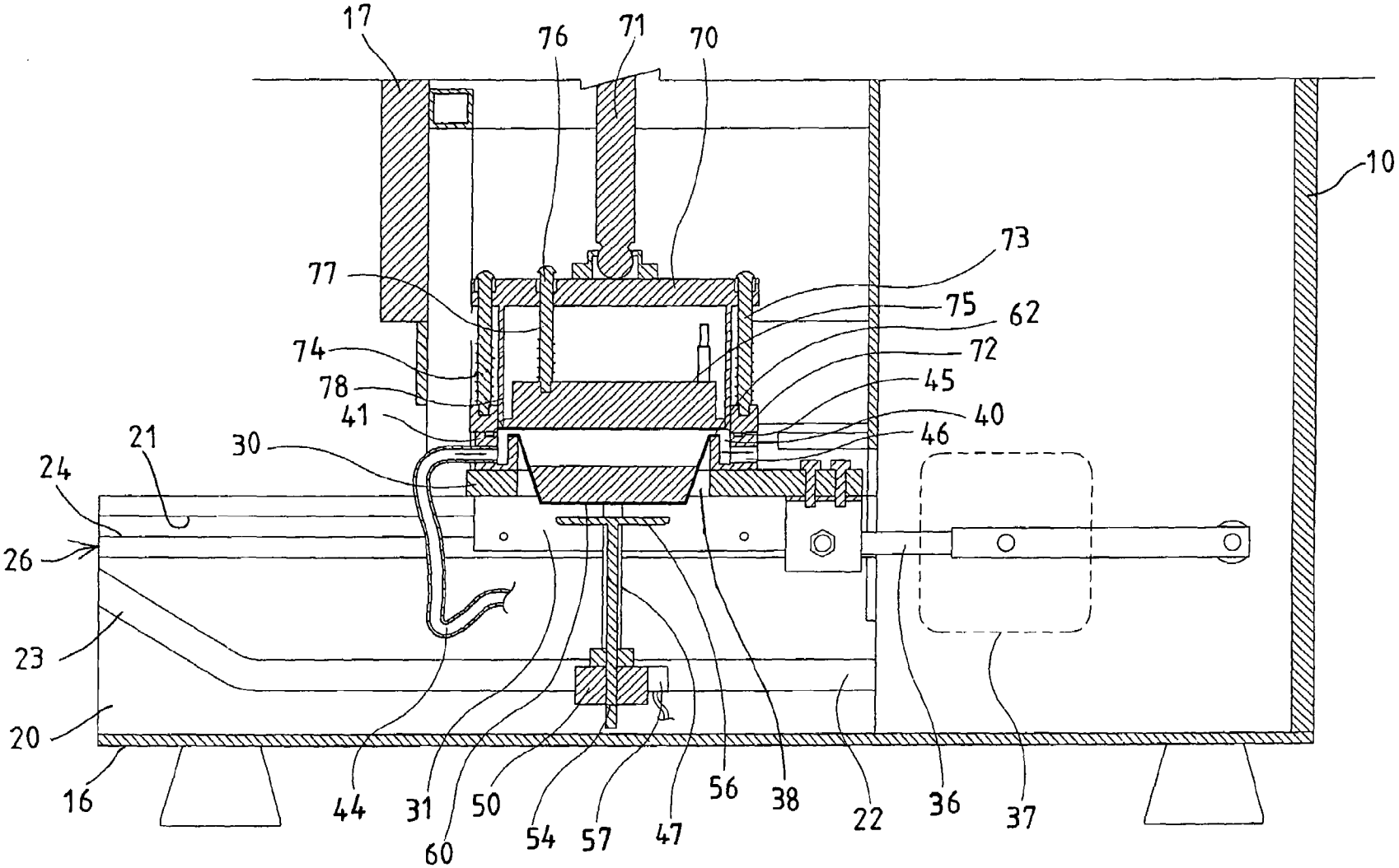

The platform 30 includes an orifice 43 formed in the outer peripheral wall 41, and communicating with the peripheral channel 40 of the peripheral bulge 39, for coupling to a hose 44 which may be coupled to a reservoir (not shown), for supplying a food preserving agent or fluid or gas, such as nitrogen, or other inert gases, into the peripheral channel 40 and the opening 38 of the platform 30, and thus for supplying the gas into the container 60 (FIG. 5). It is preferable that a sealing ring 45 is provided and engaged on the outer peripheral wall 41 of the peripheral bulge 39.

For example, the food preserving agent or the inert gases supplied into the container 60 may preserve the food, the beverage or the like contained within the containers 60 from being spoiled, decomposed, or the like, and may also be used to prevent the electric parts or other objects contained within the containers 60 from being contacted with air and/or from being rusted. The platform 30 may further include an aperture 46 formed in the outer peripheral wall 41, and communicating with the peripheral channel 40 of the peripheral bulge 39, for coupling to a vacuum source or device (not shown), which may be used to draw air out, or to vacuum the containers 60, and/or for facilitating the supplying of the gas into the container 60.

A lever 50 includes two ends or two end rollers 51 slidably engaged in the channels 22 of the fences 20, and arranged to allow the lever 50 to be moved toward or away from the platform 30 when the ends or the end rollers 51 of the lever 50 are slid along the inclined front portions 23 of the channels 22 of the fences 20. The lever 50 further includes one or more orifices 52 formed therein. The platform 30 includes one or more posts 47 extended downwardly therefrom, and slidably engaged through the orifices 52 of the lever 50, to guide the lever 50 to move toward or away from the platform 30, and to guide the lever 50 to slide along the inclined front portions 23 and the channels 22 of the fences 20.

A support device 53 may further be provided and attached to the lever 50. For example, the support device 53 includes a bolt or a threaded member 54 for threading with a screw hole 55 of the lever 50, and a board 56 provided or disposed on top of the threaded member 54, for supporting the containers 60 to be sealed with the cover 61 with the sealing member 12. A detector 57 may be attached to the lever 50 and/or to the board 56, to detect whether a container 60 has been disposed and supported on the board 56 of the support device 53 or not.

A panel 70 is slidably disposed in the casing 17, and coupled, with an arm 71, to an actuating means or device 80

(FIG. 3), such as a hydraulic or pneumatic actuating device 80, a solenoid actuating device 80, a motorized screw or helical device 80, a motorized gearing device 80, or the like, which may be used to move the panel 70 up and down relative to the casing 17. A peripheral presser rim 72 includes one or more guide pins 73 extended therefrom, and slidably attached to the panel 70, to guide the peripheral presser rim 72 to move up and down relative to the panel 70.

A spring member 74 may be engaged onto each of the guide pins 73, and engaged between the peripheral presser rim 72 and the panel 70, to bias the peripheral presser rim 72 away from the panel 70 and toward the outer peripheral wall 41 and/or the sealing ring 45, and thus to depress and to engage or to force the sealing member 12 between the peripheral presser rim 72 and the outer peripheral wall 41 (FIG. 5).

Figure 6:
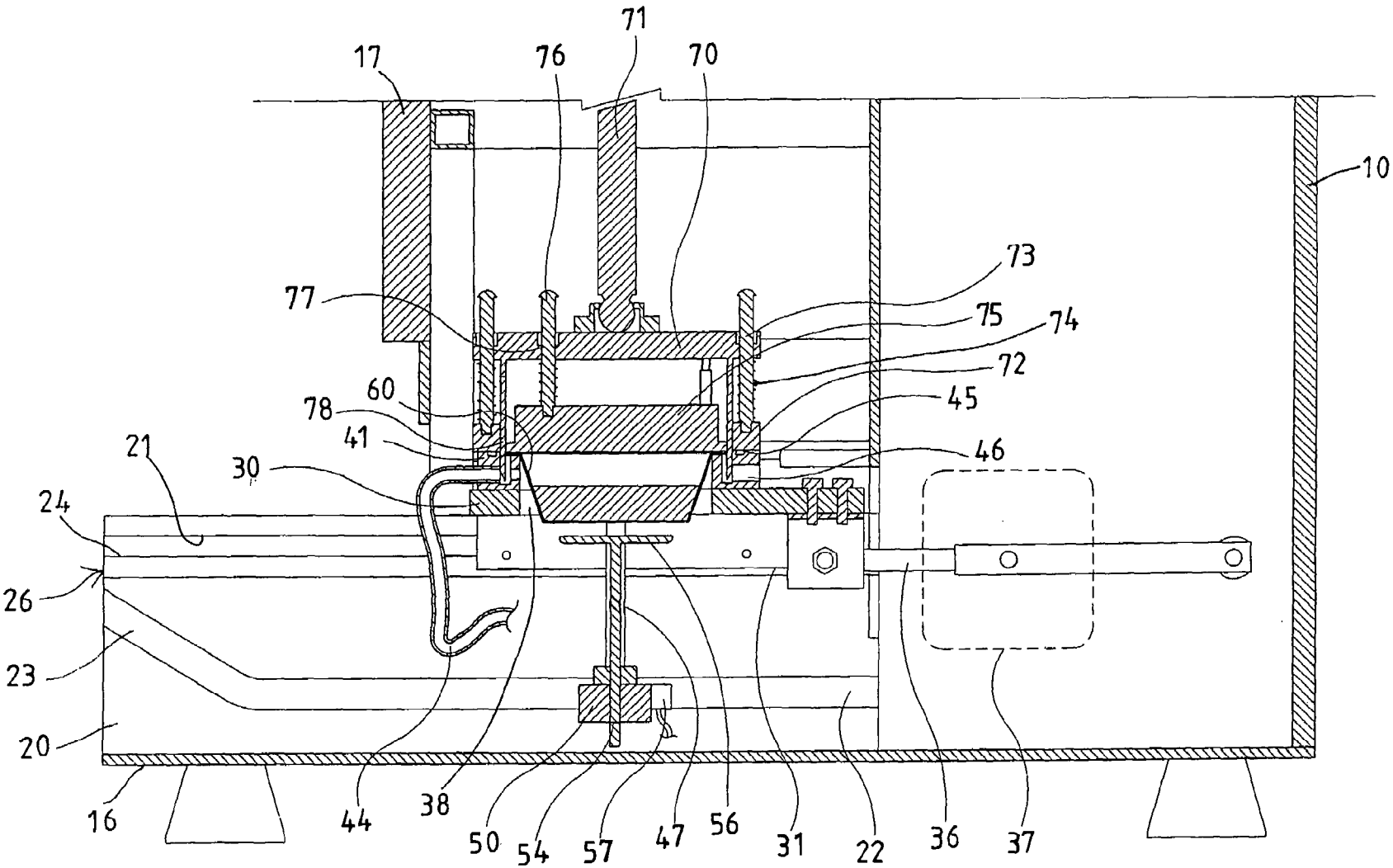

A heater member 75 includes one or more guide columns 76 extended therefrom, and slidably attached to the panel 70, to guide the heater member 75 to move up and down relative to the panel 70. A spring member 77 may also be provided and engaged onto each of the guide columns 76, and engaged between the heater member 75 and the panel 70, to bias the heater member 75 away from the panel 70 and toward the inner peripheral wall 42 and the outer peripheral flange 62 of the container 60, and thus to heat and to seal the sealing member 12 onto the outer peripheral flange 62 of the container 60 (FIG. 6).

Figure 7:
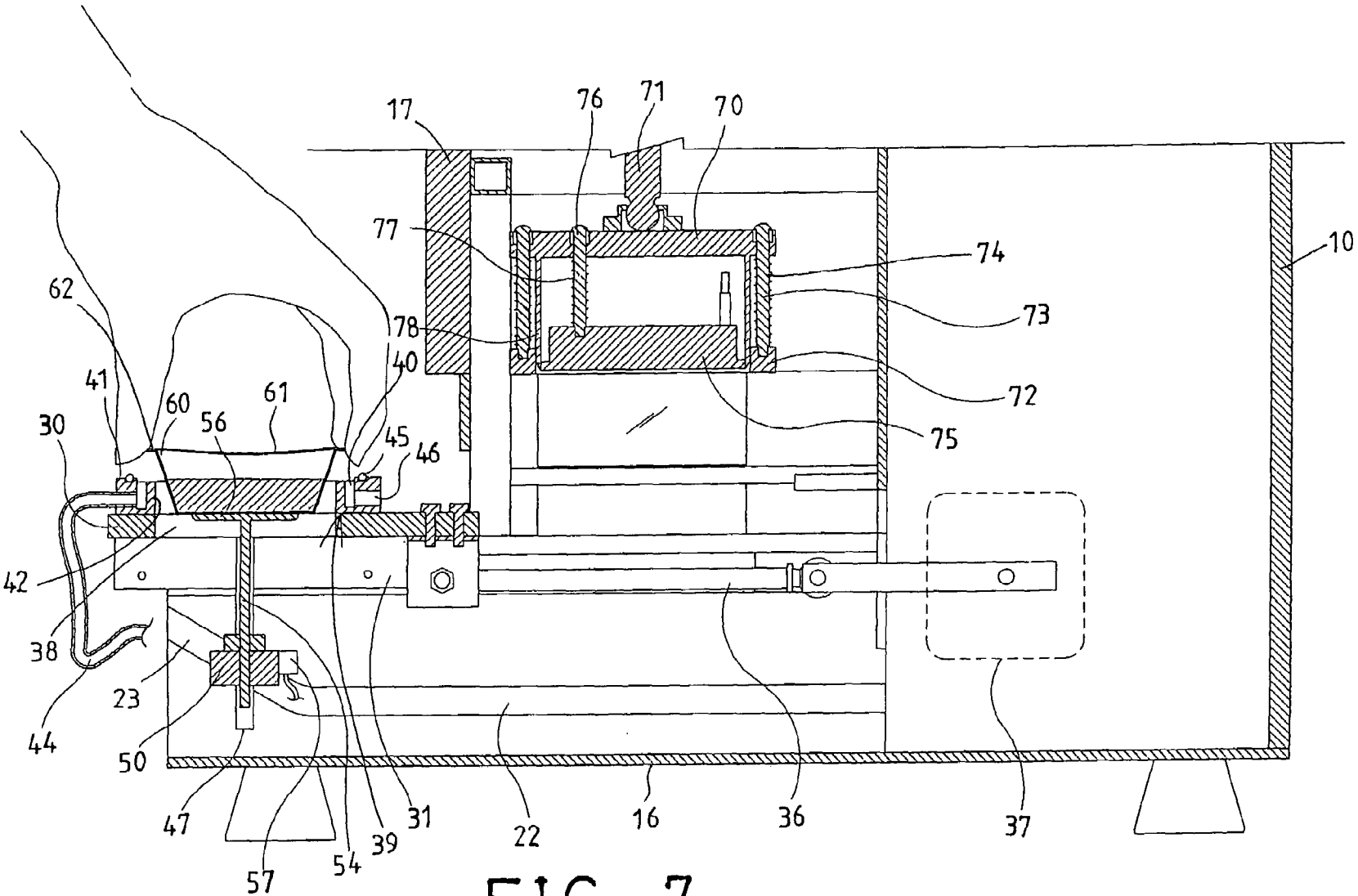

A peripheral cutter blade 78 may be extended downwardly from the panel 70, and preferably disposed or arranged between the peripheral presser rim 72 and the heater member 75, for cutting the sealing member 12, after the sealing member 12 has been heated and sealed onto the outer peripheral flange 62 of the container 60 (FIG. 6) as the cover 61 of the container 60 (FIG. 7).

In operation, as shown in FIG. 3, the platform 30 may be moved in and out of the casing 17 by the moving means or device 37 via the link 36. A container 60 to be sealed may then be disposed into the opening 38 of the platform 30 and supported on the board 56 of the support device 53. The detector 57 may be used to detect whether the container 60 has been disposed and supported on the board 56 of the support device 53 or not.

For example, when the detector 57 has detected that a container 60 has been disposed and supported on the board 56 of the support device 53, a message or signal may be sent to a processor device (not shown) which may then actuate the moving means or device 37 to move the platform 30 into the casing 17 (FIG. 4), and arranged and located below the peripheral presser rim 72 and the heater member 75.

After the platform 30 has been moved into the casing 17, the end rollers 51 of the lever 50 may slide downwardly along the inclined front portions 23 and into the channels 22 of the fences 20, such that the board 56 of the support device 53 may also be lowered relative to the platform 30, to allow the allow the outer peripheral flange 62 of the container 60 to be supported or seated on the inner peripheral wall 42 of the peripheral bulge 39.

As shown in FIG. 5, the panel 70 may then be moved downwardly toward the platform 30 and the container 60, to force the peripheral presser rim 72 toward the outer peripheral wall 41 and/or the sealing ring 45, and to depress and force and retain the sealing member 12 between the peripheral presser rim 72 and the outer peripheral wall 41. As shown in FIG. 6, the heater member 75 may then be biased and forced by the spring member 77, toward the inner peripheral wall 42 and the outer peripheral flange 62 of the container 60, and thus to heat and to seal the sealing member 12 onto the outer peripheral flange 62 of the container 60.

After the sealing member 12 has been heated and sealed onto the outer peripheral flange 62 of the container 60 as the cover 61 of the container 60 (FIG. 7), the peripheral cutter blade 78 may moved downwardly by the panel 70, to cut the sealing member 12, and to separate the cover 61 of the container 60 from the sealing member 12, and to leave the cover 61 on the container 60. The platform 30 may then be moved out of the casing 17 by the moving means or device 37, as shown in FIG. 7, to allow the container 60 to be picked up by the users.

It is to be noted that, as shown in FIG. 5, before the sealing member 12 is heated and sealed onto the outer peripheral flange 62 of the container 60, an object or an agent, or a fluid or gas, such as nitrogen, or other inert gases, may be introduced or supplied into the peripheral channel 40 and the opening 38 of the platform 30, and then may be supplied into the container 60. The peripheral channel 40 of the platform 30 and/or the hose 44 may thus be formed as a filling structure or device or means for filling the object or the agent into the container 60 before the sealing member 12 is heated and sealed onto the outer peripheral flange 62 of the container 60.

The objects, or the agents, such as the nitrogen or the other inert gases may be used to preserve the food, the beverage or the like contained within the containers 60 from being spoiled, decomposed, or the like, and may also be used to prevent the electric parts or other objects contained within the containers 60 from being contacted with air and/or from being rusted.

It is to be noted that he typical container sealing devices or the typical automatic film-lid cohering machines may not be used to introduce or to supply any object into the containers before the film is attached or sealed onto the containers.

The board 56 of the support device 53 may be threaded and adjusted relative to the lever 50 by the bolt or threaded member 54 of the support device 53, and may thus be adjusted relative to the platform 30, to allow containers 60 of different heights or depths to be suitably or adjustably supported on the platform 30 and on the board 56 of the support device 53.

Accordingly, the container sealing device includes a structure for filling or introducing gas into containers, to preserve and/or to prevent food, electric parts or other objects contained within the containers from being spoiled, decomposed, or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A container sealing device comprising:

a platform including an opening formed therein for receiving a container to be sealed, a sealing member located above the container and said platform, means for sealing said sealing member onto the container, to seal the container, and means for filling of an object into the container before said sealing member is sealed onto an outer peripheral flange of the container, said filling means including a peripheral bulge extended upwardly from said platform, and a peripheral channel formed in said peripheral bulge and arranged around said opening thereof, to define an outer peripheral wall and an inner peripheral wall, said inner peripheral wall being provided to support an outer peripheral flange of the container.

2. The container sealing device as claimed in claim 1, wherein said platform includes an orifice formed in said outer peripheral wall and communicating with said peripheral channel of said peripheral bulge, for coupling to a food preserving agent reservoir.

3. The container sealing device as claimed in claim 1, wherein said platform includes an aperture formed in said outer peripheral wall and communicating with said peripheral channel of said peripheral bulge, for coupling to a vacuum device and for vacuuming the container.

4. The container sealing device as claimed in claim 1, wherein said inner peripheral wall of said peripheral bulge of said platform is lower than said outer peripheral wall, for supporting the outer peripheral flange of the container.

5. The container sealing device as claimed in claim 1, wherein said sealing means includes a panel, and a heater member slidably attached to said panel, for being moved to heat and to seal said sealing member onto the outer peripheral flange of the container.

6. The container sealing device as claimed in claim 5, wherein said heater member includes at least one guide column extended therefrom and slidably with said panel, and a spring member engaged between said heater member and said panel, to bias said heater member away from said panel and toward said inner peripheral wall and the outer peripheral flange of the container.

7. The container sealing device as claimed in claim 5, wherein said panel includes a cutter blade extended therefrom, for cutting said sealing member after said sealing member has been heated and sealed onto the outer peripheral flange of the container.

8. The container sealing device as claimed in claim 5, wherein a presser rim is slidably attached to said panel, for being moved to depress and to force said sealing member between said presser rim and said outer peripheral wall of said peripheral bulge of said platform.

9. The container sealing device as claimed in claim 8, wherein said presser rim includes at least one guide pin extended therefrom, and slidably attached to said panel, and a spring member engaged onto said at least one guide pin, and engaged between said presser rim and said panel, to bias said presser rim toward said outer peripheral wall.

10. A container sealing device comprising:

a platform including an opening formed therein for receiving a container to be sealed, a sealing member located above the container and said platform, means for sealing said sealing member onto the container, to seal the container, means for filling of an object into the container before said sealing member is sealed onto an outer peripheral flange of the container, and a base including at least one fence disposed thereon and having a guide rail provided therein, and having a channel formed therein and having an inclined portion for slidably receiving said platform, a lever having at least one end slidably engaged in said channel of said at least one fence, and coupled to said platform, to guide said lever to move up and down relative to said platform when said at least one end of said lever slides along said inclined portion of said channel of said at least one fence.

11. The container sealing device as claimed in claim 10, wherein said lever includes a screw hole formed therein, a support device is arranged to support the container and includes a threaded member for threading with said screw hole of said lever, and a board provided on top of said threaded member, for supporting the container to be sealed with the sealing member.

12. The container sealing device as claimed in claim 11, wherein said lever includes a detector attached thereto, to detect whether the container has been disposed and supported on said board of said support device or not.

13. The container sealing device as claimed in claim 10, wherein said at least one fence includes a slot formed therein, and said guide rail includes two poles secured in said slot of said at least one fence.

14. The container sealing device as claimed in claim 13, wherein said platform includes a bar secured to a bottom thereof and having a depression formed therein for receiving and securing a pole, said pole of said bar is slidably engaged with said poles of said guide rail of said at least one fence, to slidably attach said platform to said base.

15. The container sealing device as claimed in claim 10, further comprising a casing provided above said base, said platform being arranged to move in and out of said casing, said sealing member being supplied through said casing, and a moving device coupled to said platform, to move said platform into and out of said casing.

16. The container sealing device as claimed in claim 15 further comprising a housing having said casing attached thereto, said housing including a spindle extended forwardly therefrom, for rotatably supporting a reel of said sealing member, and a rod extended forwardly therefrom, for receiving said sealing member unwound from said spindle.

* * * * *